US006283604B1

(12) United States Patent
Liao

(10) Patent No.: US 6,283,604 B1
(45) Date of Patent: Sep. 4, 2001

(54) ELECTRO LUMINESCENT ILLUMINATOR

(76) Inventor: Ching-Shin Liao, No. 467, Ta-Li Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/399,731

(22) Filed: Sep. 20, 1999

(51) Int. Cl.[7] ..... F21V 9/16
(52) U.S. Cl. ..... 362/84; 362/252; 362/249
(58) Field of Search ..... 362/84, 800, 806, 362/125, 126, 808, 252, 249

(56) References Cited

U.S. PATENT DOCUMENTS 3,957,331 * 5/1976 Tantillo et al. ..... 339/6 R
5,621,991 * 4/1997 Gustafson ..... 40/544
5,711,594 * 1/1998 Hay ..... 362/84
5,722,760 * 3/1998 Chien ..... 362/84
5,779,346 * 7/1998 Burke ..... 362/84
5,964,516 * 10/1999 Lai ..... 362/95

* cited by examiner

*Primary Examiner*—Sandra O'Shea
*Assistant Examiner*—Guiyoung Lee
(74) *Attorney, Agent, or Firm*—Bacon & Thomas, PLLC

(57) ABSTRACT

A electro luminescent illuminator, which includes a lamp holder and a luminous body mounted on the lamp holder, wherein the lamp holder has a plurality of equiangularly spaced recessed top plug holes, a plurality of conductor holes respectively disposed in the recessed top plug holes at a bottom side, a current transformer with an electric plug at a bottom side thereof for connection to AC power supply, and a plurality of conductors respectively connected between the current transformer and the conductor holes; the luminous body includes a plurality of electro luminescent luminous strips respectively fastened to the plug holes at the lamp holder, the electro luminescent luminous strips each having a plurality of lead wires respectively plugged into the conductor holes at the lamp holder.

2 Claims, 8 Drawing Sheets

ELECTRO LUMINESCENT ILLUMINATOR

BACKGROUND OF THE INVENTION

The present invention relates to illuminators, and more particularly to a electro luminescent illuminator.

Regular desk lamps, night lamps, indicator lamps commonly use a bulb or bulbs to produce light. A lamp bulb is generally comprised of base, a glass bulb mounted on the base, and a filament suspended inside the glass bulb. A lamp bulb must be carefully handled because it is fragile. When a lamp works, it produces heat, and its glass bulb becomes hot within a short length of time. The user will get the hand burnt when touching the hot glass bulb. If cold water is accidentally dropped to the hot glass bulb of a lamp, the lamp may explode. Furthermore, these conventional lamps are not durable in use because the filament burns out quickly with use.

SUMMARY OF THE INVENTION

The present invention has been accomplished to provide an illuminaotr which eliminates the aforesaid drawbacks. It is the main object of the present invention to provide a electro luminescent illuminator which is safe and durable in use, and does not produce heat during its operation. It is another object of the present invention to provide a electro luminescent illuminator which is economic, and detachable. To achieve these and other objects of the present invention, there is provided electro luminescent illuminator comprised of a lamp holder and a luminous body mounted on the lamp holder, wherein the lamp holder has a plurality of equiangularly spaced recessed top plug holes, a plurality of conductor holes respectively disposed in the recessed top plug holes at a bottom side, a current transformer with an electric plug at a bottom side thereof for connection to AC power supply, and a plurality of conductors respectively connected between the current transformer and the conductor holes; the luminous body includes a plurality of electro luminescent luminous strips respectively fastened to the plug holes at the lamp holder, the electro luminescent luminous strips each having a plurality of lead wires respectively plugged into the conductor holes at the lamp holder.

DETAILED DESCRIPTION OF THE PREFERRED EMBODIMENT

Figure 1:
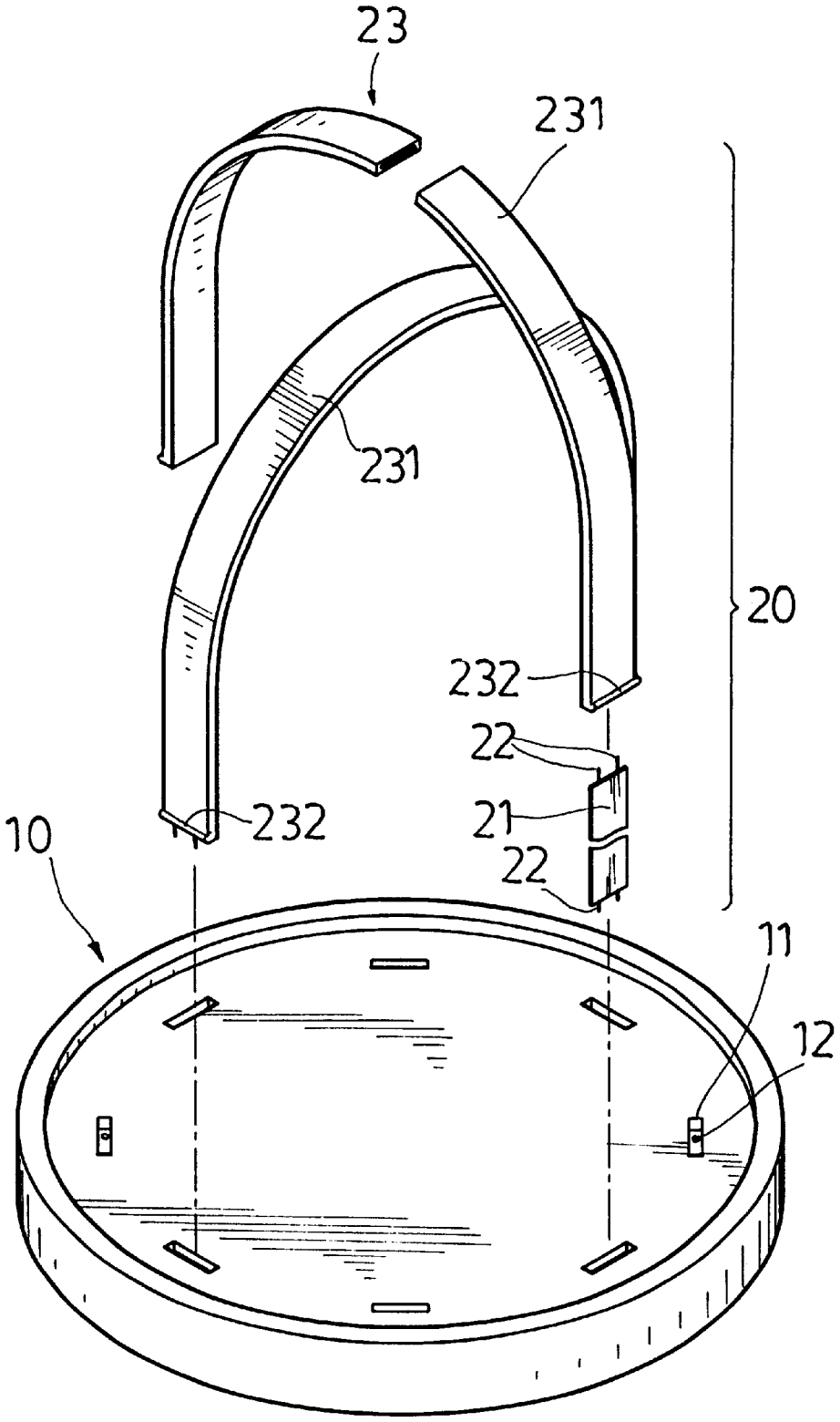
FIG. 1 is an exploded view of a electro luminescent illuminator according to a first embodiment of the present invention.
Figure 2:
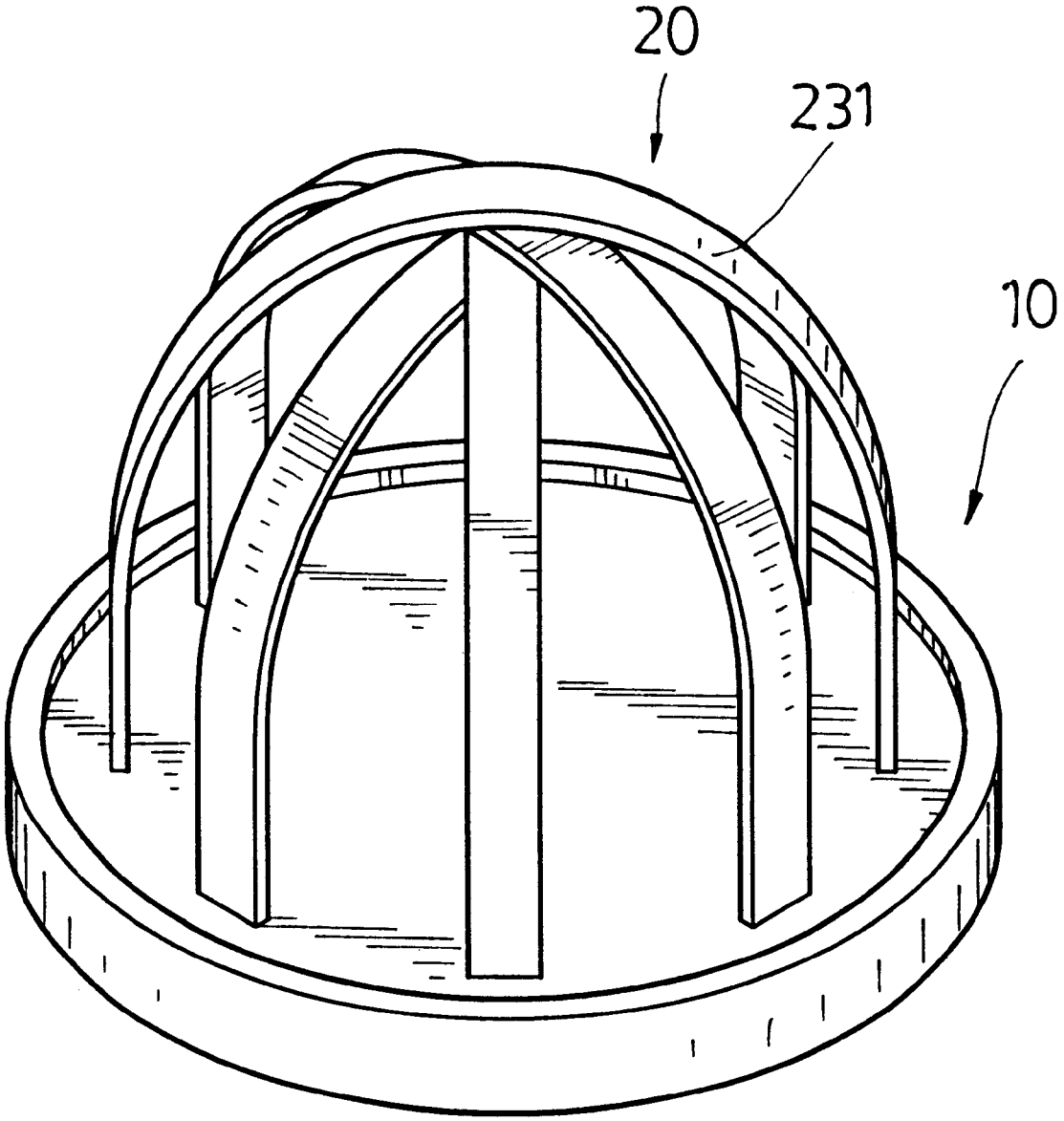
FIG. 2 is an elevational view of the electro luminescent illuminator shown in FIG. 1.
Figure 3:
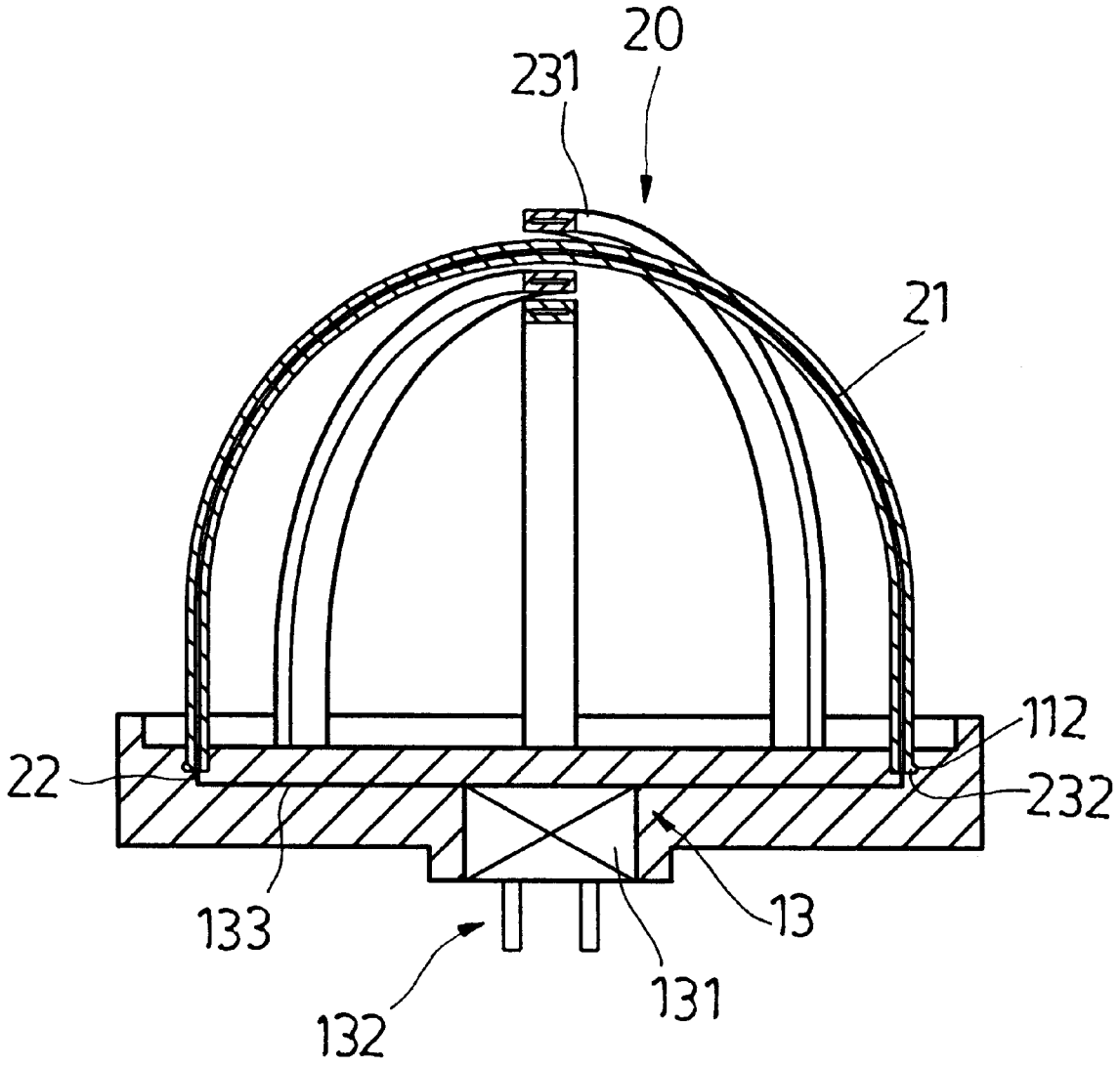
FIG. 3 is a side view in section of FIG. 2.

Referring to FIGS. 1, 2 and 3, a electro luminescent illuminator in accordance with the present invention is generally comprised of a lamp holder 10, and a luminous body 20.

The lamp holder 10 is a disk-like member having a plurality of recessed plug holes 11 equiangularly spaced at the top near the border thereof, a plurality of conductor holes 12 respectively disposed in the recessed plug holes 11 at a bottom side, and a plurality of recessed retaining portions 112 respectively provided in the plug holes 11 at one side. The conductor holes 12 are respectively electrically connected to a power circuit assembly 13. The power circuit assembly 13 comprises a current transformer 131 installed in the lamp holder 10, an electric plug 132 extended from the current transformer 131 out of the bottom side wall of the lamp holder 10 for connection to an electric outlet to receive AC power supply, and a plurality of conductors 133 respectively connected between the power output end of the current transformer 131 and the conductor holes 12. The electric plug 132 shown in FIG. 3 is of the type having two protruded metal blades for inserting into the two insertion holes of an electric socket.

Figure 8:
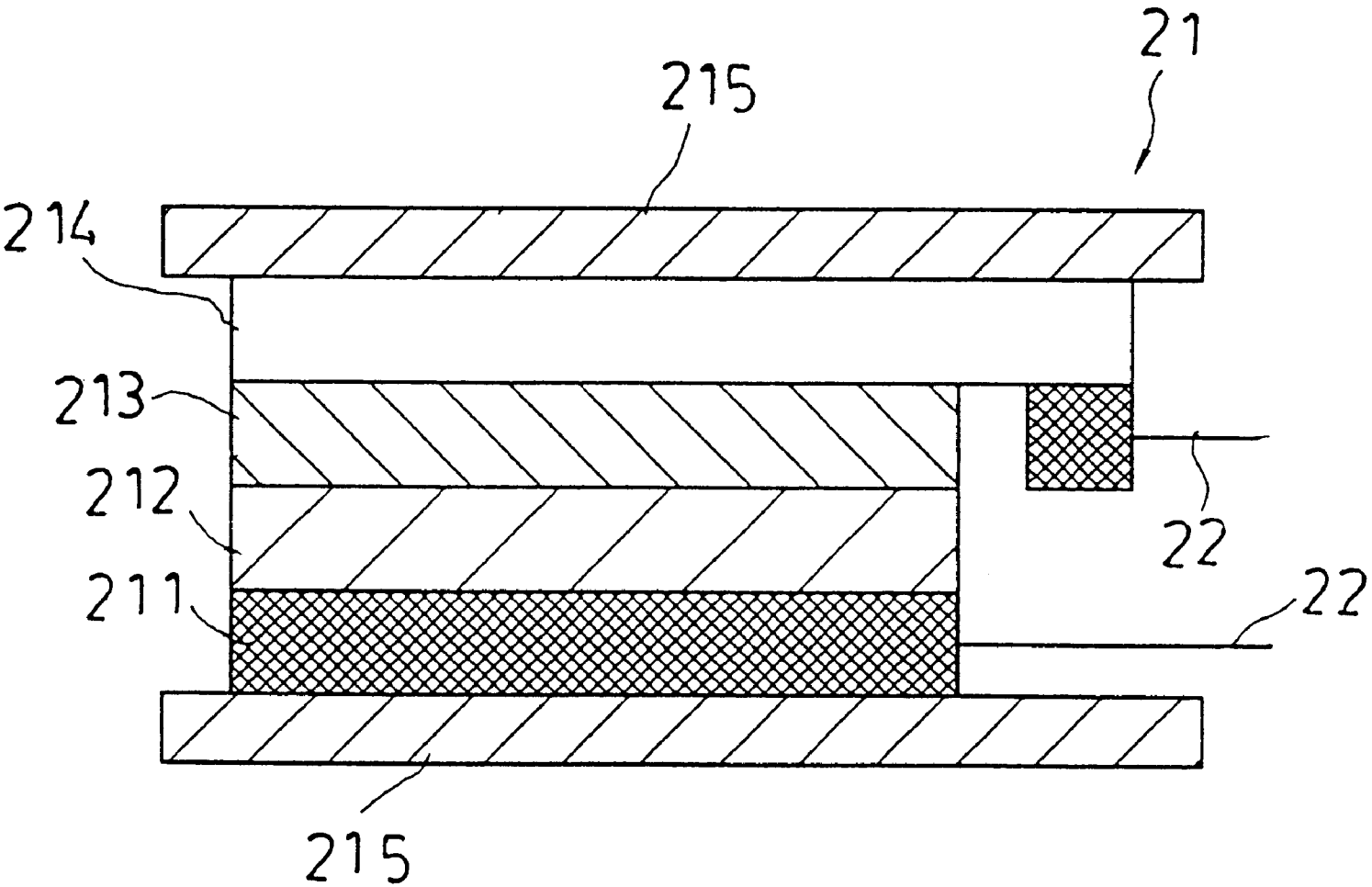
FIG. 8 is a sectional view of a resilient electro luminescent luminous strip for a luminous body according to the present invention.

The luminous body 20 is comprised of a plurality of resilient electro luminescent luminous strips 21, and protective means 23. The protective means 23 is comprised of a plurality of arched, hollow, transparent sheaths 231, each having two hooked portions 232 at two opposite ends for engagement with the recessed retaining portions 112 in the lamp holder 10. The resilient electro luminescent luminous strips 21 are respectively inserted through the transparent sheaths 231. The resilient electro luminescent luminous strips 21 (as shown in FIG. 8) each are comprised of an elongated resilient conductor (for example, a copper plate or copper wire) 211, an insulative layer 212 covered on the resilient conductor 211, a luminous layer (electroluminescent layer) 213 covered on the insulative layer 212, an electrically conductive layer 214 covered on the luminous layer 213, and a protective layer 215 covered on the electrically conductive layer 214. The resilient electro luminescent luminous strips 21 can be shaped like a long, narrow band, or a wire rod. The electrically conductive layer 214 and the protective layer 215 of each resilient electro luminescent luminous strip 21 are transparent. Lead wires 22 are respectively extended out of two opposite ends of each of the resilient conductor 211 and the electrically conductive layer 214. When assembled, the lead wires 22 of each resilient electro luminescent luminous strip 21 are respectively extended out of two opposite ends of the respective transparent sheath 231. The two opposite ends of the transparent sheath 231 of each of the resilient electro luminescent luminous strips 21 of the luminous body 20 are respectively plugged into each opposite plug holes 11 at the lamp holder 10, permitting the hooked portions 232 to be respectively forced into engagement with the recessed retaining portions 112 in the plug holes 11 and the lead wires 22 to be respectively engaged into the conductor holes 12. The resilient electro luminescent luminous strips 21 have different lengths, so that they can be bridged over one another when installed in the lamp holder 10. When the power circuit assembly 13 is connected to power source, the resilient conductor 211 and electrically conductive layer 214 of each of the electro luminescent luminous strips 21 are energized to produce an AC biased field, thereby causing the fluorescent electrons at the luminous layer 213 to strike one against another, and to produce light. The luminous layer 213 can have any of a variety of colors such as orange, purple, blue green, green blue, green yellow, etc., subject to the fluorescent material used. The protective layer 215 of each of the electro luminescent luminous strips 21 or the transparent sheaths 231 can be made having any of a variety of colors, and used as color filter means to control the color of light of the luminous body 20.

Figure 4:
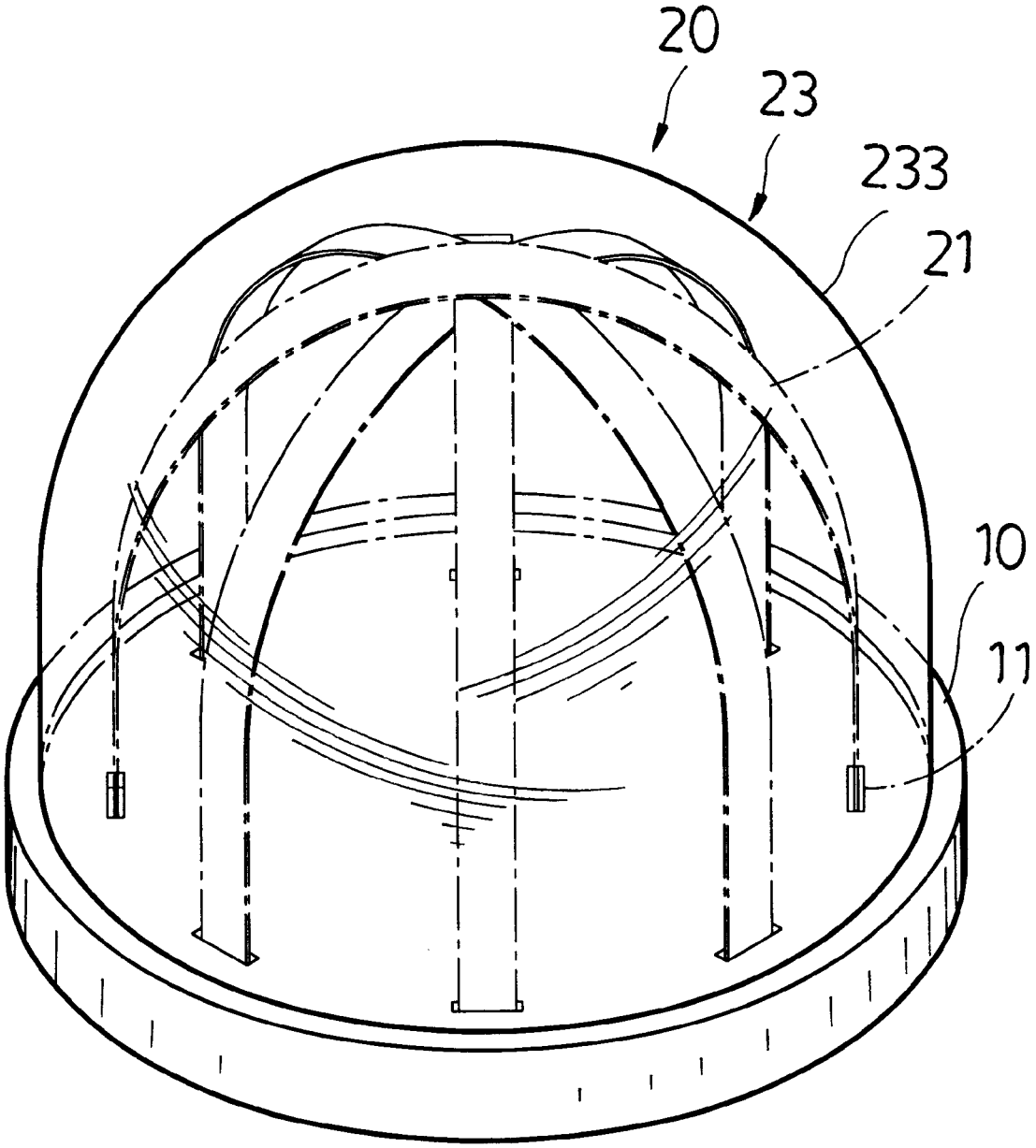
FIG. 4 is a perspective view of a electro luminescent illuminator according to a second embodiment of the present invention.
Figure 5:
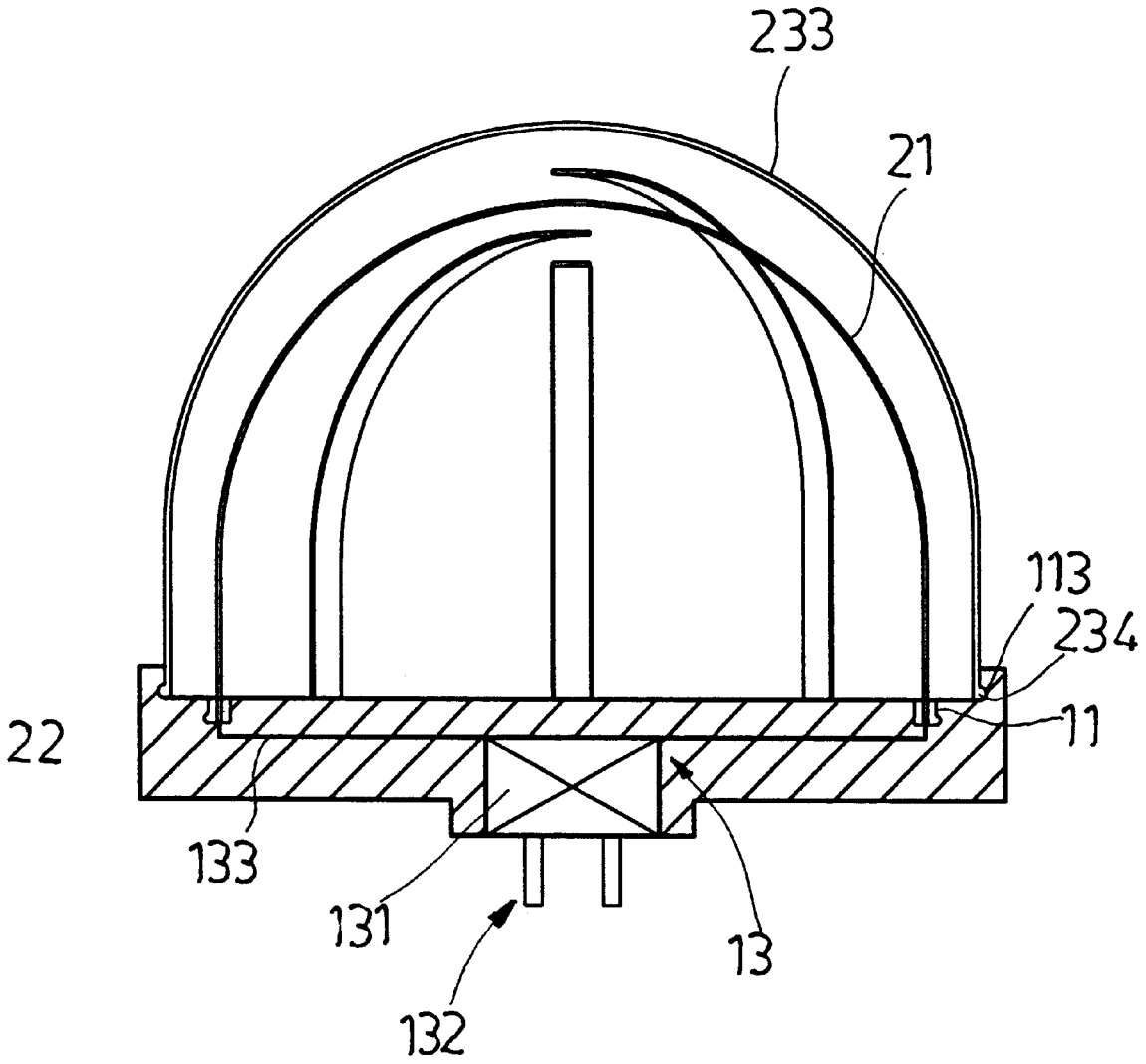
FIG. 5 is a side view in section of the second embodiment shown in FIG. 4.

FIGS. 4 and 5 show an alternate form of the present invention. According to this alternate form, the luminous body 20 is comprised of a plurality of arched electro luminescent luminous strips 21 fastened to the plug holes 11 at the lamp holder 10 and bridged over one another, and protective means 23, which is a transparent hemispherical shield 233 having a coupling flange 234 raised around the periphery thereof and forced into engagement with a coupling groove 113 at the lamp holder 10.

Figure 6:
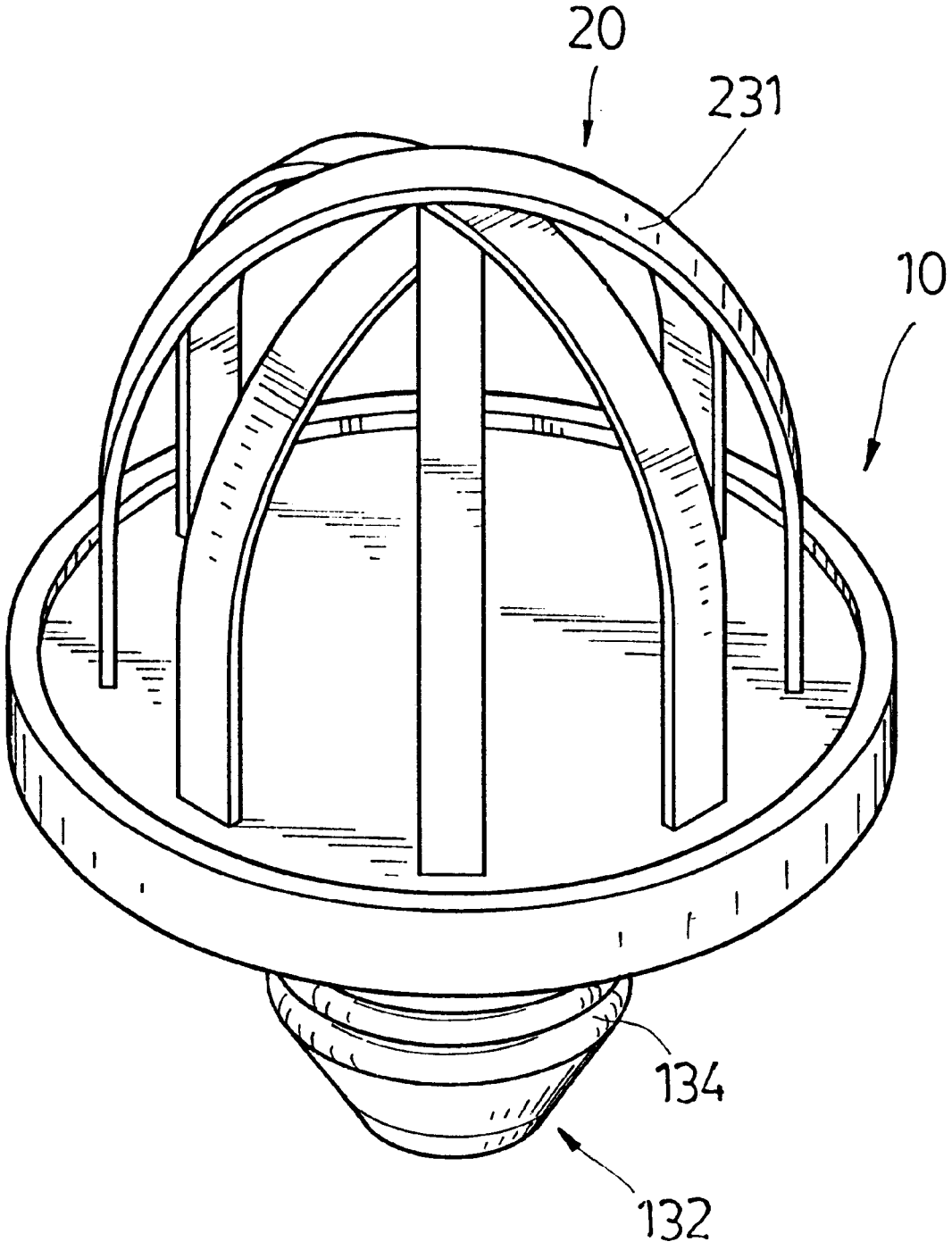
FIG. 6 is an elevational view of a electro luminescent illuminator according to a third embodiment of the present invention.

FIG. 6 shows another alternate form of the present invention. According to this alternate form, the electric plug 132 of the power circuit assembly 13 comprises a swivel connector 134 for fastening to a matched connector at an electric socket.

As indicated above, the electro luminescent illuminator of the present invention achieves the followings features:

1. Because the luminous body 20 is comprised of a plurality of resilient electro luminescent luminous strips 21, it consumes less power supply and does not produce heat during working, and its light is soft.
2. Because the protective means 23, i.e., the hollow, transparent sheaths 231 and the transparent hemispherical shield 233 can be molded from plastics or acrylics, the luminous body 20 is well protected, and can be conveniently handled by hand.
3. The electro luminescent luminous strips 21 are resilient, they can be bent to the desired shape, or arranged into the desired array.
4. The electro luminescent luminous strips 21 or the hemispherical shield 233 can be conveniently removed from the lamp holder 10 for a repair work. Disengaging the hooked portions 232 from the recessed retaining portions 112 or the coupling flange 234 from the coupling groove 113 can easily be done by squeezing the electro luminescent luminous strips 21 or hemispherical shield 233 inwards. When one electro luminescent luminous strip 21 is unable to function well, it can be removed from the respective protective sheath 231 for a replacement.
5. Because the power circuit assembly 13 includes an electric plug 132 with/without a swivel connector 134, the electro luminescent illuminator can be directly installed in an electric outlet for use as a night lamp, desk lamp, indicator lamp, etc.
6. By adding a selector switch to selectively control the operation of the electro luminescent luminous strips 21, the intensity of light is relatively regulated.
7. The electro luminescent luminous strips 21 can be made having different colors, or used with different colors of protective sheaths 231 to produce a lighting effect.
8. The electro luminescent luminous strips 21 can be arranged to form a pattern. Alternatively, the shield 233 can be made having any of a variety of shapes.

Figure 7:
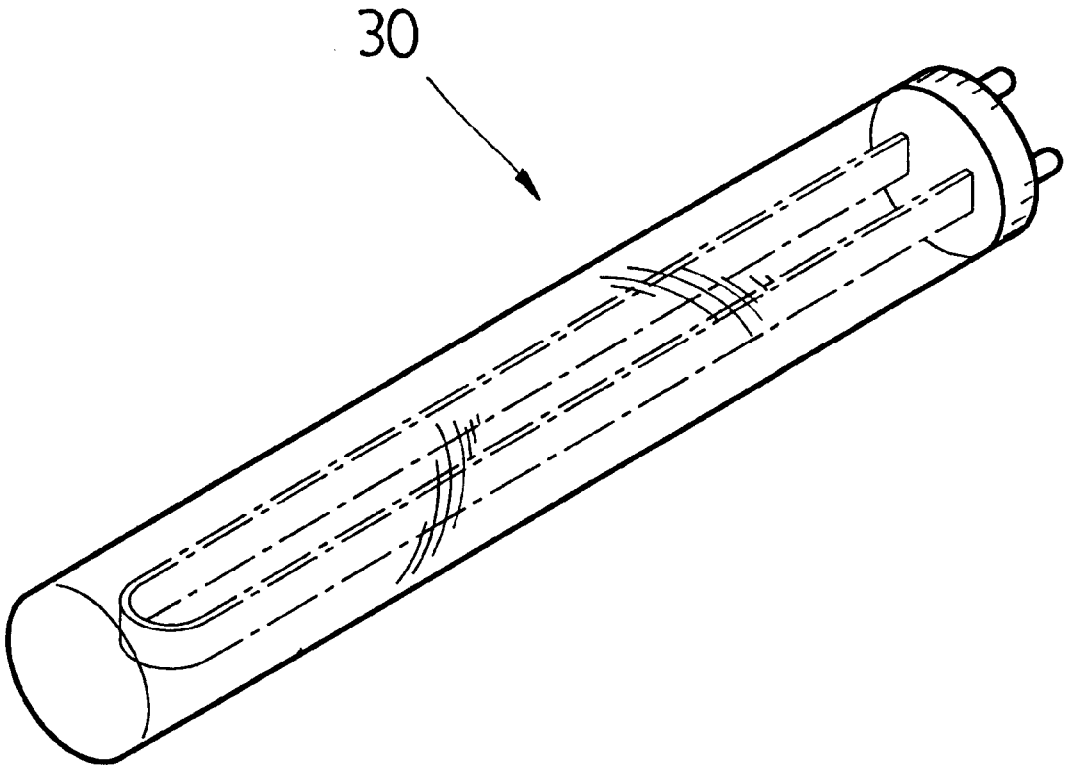
FIG. 7 is a perspective view of a electro luminescent illuminator according to a fourth embodiment of the present invention.

It is to be understood that the drawings are designed for purposes of illustration only, and are not intended as a definition of the limits and scope of the invention disclosed. For example, the a transparent hemispherical shield 233 can be used in the embodiment shown in FIG. 6 instead of the transparent sheaths 231; the electro luminescent illuminator can be made in the shape of lamp tube 30 as shown in FIG. 7.

What is claimed is:

1. A electro luminescent illuminator comprising a lamp holder and a luminous body mounted on said lamp holder, wherein said lamp holder comprises a disk-like body having a plurality of recessed plug holes arranged in pairs at a top side wall thereof, a plurality of conductor holes respectively disposed in said recessed plug holes at a bottom side, and a power circuit assembly mounted in said disk-like body and connected to said conductor holes, said power circuit assembly comprising a current transformer mounted in said disk-like body, an electric plug extended from said current transformer to the outside of said lamp holder for connection to an AC power supply, a plurality of conductors respectively connected between a power output end of said current transformer and said conductor holes, said luminous body is comprised of a plurality of electro luminescent luminous strips respectively fastened to the plug holes at said lamp holder, said electro luminescent luminous strips each having a plurality of lead wires respectively plugged into said conductor holes at said lamp holder, a plurality of recessed retaining portions respectively disposed in said plug holes at one side; said luminous body further comprises a plurality of arched, hollow, light permeable protective sheaths respectively sleeved onto said electro luminescent luminous strips and fastened to the plug holes at said lamp holder, said protective sheaths each having two hooked portions at two opposite ends respectively inserted into the plug holes at said lamp holder and forced into engagement with the recessed retaining portions in the plug holes at said lamp holder.

2. The electro luminescent illuminator of claim 1 wherein said protective sheaths are respectively fastened to the plug holes at said lamp holder and bridged over one another.

* * * * *